United States Patent [19]

Hardin

[11] Patent Number: 5,065,676

[45] Date of Patent: Nov. 19, 1991

[54] AXIALLY REVERSING ROLLER FOR PRINTING PRESSES AND SHEET COATING MACHINES

[76] Inventor: Philip J. Hardin, 850 Park La., Elm Grove, Wis. 53225

[21] Appl. No.: 178,871

[22] Filed: Apr. 8, 1988

Related U.S. Application Data

[63] Continuation of Ser. No. 892,901, Aug. 4, 1986, abandoned.

[51] Int. Cl.[5] ..... B41F 31/00

[52] U.S. Cl. ..... 101/349; 101/348; 101/205; 101/206; 101/354; 101/DIG. 38

[58] Field of Search ..... 101/205, 206, 207, 208, 101/209, 348, 349, 350, 351, 352, 354, 355, 356, 357, 358, 360, 361

[56] References Cited

U.S. PATENT DOCUMENTS

| | | | |
|---|---|---|---|
| 3,765,328 | 10/1973 | Treft et al. | 101/DIG. 14 X |
| 3,983,812 | 10/1976 | Schramm | 101/DIG. 14 X |
| 4,205,605 | 6/1980 | Greiner et al. | 101/DIG. 14 X |
| 4,337,699 | 7/1982 | Beisel | 101/348 |
| 4,428,290 | 1/1984 | Junghaus et al. | 101/348 |
| 4,509,426 | 4/1985 | Hardin | 101/348 |
| 4,632,029 | 12/1986 | Simeth | 101/348 |
| 4,672,894 | 6/1987 | Hardin | 101/348 |

FOREIGN PATENT DOCUMENTS

| | | | |
|---|---|---|---|
| 617613 | 4/1961 | Canada | 101/348 |
| 929486 | 7/1949 | Fed. Rep. of Germany | 101/348 |
| 1910159 | 2/1969 | Fed. Rep. of Germany | 101/348 |
| 280015 | 11/1927 | United Kingdom | 101/348 |

*Primary Examiner*—Edgar S. Burr
*Assistant Examiner*—Eric Raciti
*Attorney, Agent, or Firm*—Fuller, Ryan & Hohenfeldt

[57] ABSTRACT

A roller for distributing a coating material such as ink in a press is mounted on a shaft for sliding axially on and rotating on the shaft. First and second internally threaded sleeves are fixed internally of the roller coaxially with each other and concentric to the shaft. One of the threads has a left hand twist and the other has a right hand twist. Two follower plungers, one having left hand thread segments and the other having right hand thread segments are meshed alternately with the left and right hand twist square threads. A link spans between double armed levers which connect to the follower plungers, respectively. When one plunger is automatically forced out of engagement with its cooperating thread in the one sleeve, a force is transmitted through the link to the other lever which causes the other follower plunger and its thread segments to mesh with the internal threads on the other sleeve so the roller changes the direction of its axial movement. A motor is provided for optionally driving the shaft rotationally when the roller peripheral speed exceeds a predetermined value so that the speed of the roller and the threaded sleeves relative to the followers is decreased with the result that axial travel rate of the roller is independently controllable and not directly proportionally to roller rotational rate.

19 Claims, 5 Drawing Sheets

AXIALLY REVERSING ROLLER FOR PRINTING PRESSES AND SHEET COATING MACHINES

This is a continuation of co-pending application Ser. No. 892,901, filed on Aug. 4, 1986, now abandoned.

BACKGROUND OF THE INVENTION

The invention disclosed herein is an improvement over U.S. Pat. No. 4,509,426 which issued on Apr. 9, 1985 to the inventor of the present application. The entire disclosure of this patent is incorporated herein by reference.

The invention is a roller that is adapted for rotating and oscillating axially while being in contact with other rollers in a machine such as in the inker of an offset printing press or in machines for applying a thin coating of material to metal and non-metallic sheets and webs. For the sake of brevity the improved axially oscillating roller will be described herein in connection with its printing press application where it applies or coats ink on sheets but it should be understood that the ink could be replaced by paint, varnish or polymer coating material in other applications.

The objective of using one or more oscillating ink rollers in the inker of offset printing presses is to obtain a uniform distribution of ink on the rollers that apply ink to the photolithographic image plates. In a printing press, at least one of the ink rollers is in tangential contact over its length with another roller that rotates in an ink bath and gets a heavy coating of ink on it. The next roller pressing against the roller in the ink bath, called the ductor roller, picks up a thinner coating of ink and transfers it to the series of rollers which, in turn, transfer and spread the ink from one roller to another until at the end of a series of rollers a thin and hopefully uniform coating exists on the last stage of rollers which are the form rollers. The form rollers make tangential contact with the image plates on the plate cylinder and, thus, deposit an ink film of one color on the image plate. As the plate cylinder rotates, it transfers the impression to a blanket cylinder for further transfer of printing on the paper sheet or web as is well known. An impression cylinder presses the paper against the blanket cylinder. The axially oscillating ink roller described in the cited patent became highly regarded by the printing industry very quickly because of its capability for obtaining not heretofore achieved uniform ink film thickness on the form rollers. The users, thus, enjoyed elimination of artifacts and, particularly, ghosting in printed sheets and webs.

The basic self-driven axially oscillating roller embodiments described in the cited patent operate on a shaft which spans across the width of a printing press. The ink roller is journaled for rotation and for reciprocating axially within limits on the shaft. The shaft is surrounded by an ink roller. A sleeve of plastic or other strong lighter than steel material fits concentrically inside of the roller. One end of the sleeve has an internal right hand square thread or helical groove in it and the axially adjacent part of the sleeve has a square thread in it. A rocker arm extends axially along the shaft and it is mounted to the shaft for pivoting about its mid-point. There is a prong at each end of the lever. When the lever rocks so that one of the prongs is engaged with the helix of one twist and the other prong is disengaged from its cooperating helix, the roller will be shifted axially in one direction because it is being rotated about its axis by a tangentially contacting adjacent roller which is power driven or receives its rotational force from other rollers in the inker. There are strikers in the sleeve at the ends of the left and right hand helixes. When the roller screws onto a prong sufficiently for the prong to reach a striker, the prong is driven out of engagement with the helix by that striker and the other prong is rocked into the oppositely twisted helix. The roller then shifts in the opposite axial direction as it continues to rotate.

Rollers of the type described in the cited patent have proved that they are capable of reducing ghosts and other artifacts by obtaining more uniform distribution of ink on the image plates. The rollers under discussion were found to have satisfactory life when used in presses that pass sheets for printing through at about 600 lineal feet per minute. At 600 lineal or peripheral feet per minute, a roller having a four inch diameter will have a rotational speed of about 573 rpm. A roller embodiment such as one of the two described in the cited patent can be designed with sufficiently low mass so that the almost instantaneous axial reversals do not set up noticeable shock or vibrations and do not put so much strain on the parts that they break or wear out prematurely. In the patented designs that were used commercially, the pitch of the square threads had to be a minimum of ¼ inch in order to provide the strength needed to withstand the shock due to the reversals. The unavoidably large thread pitch is acceptable in oscillating rollers of about three or more inches in diameter because the amount of axial movement per revolution of the roller is small and the number of revolutions between reversals is relatively small. However, in small diameter rollers axial travel per revolution is high when the helix or thread pitch is large which means that for any selected amount of axial travel the number of reversals will be greater. It is desirable to minimize the number of reversals because it is the changes in momentum incidental to axial reversal that causes the greatest wear in axially reciprocating rollers. Because the square thread pitch had to be quite large in the patented embodiment, small rollers such as two inch diameter rollers using the totally self-contained oscillating mechanism described in the patent were not acceptable. Thus, presses having sizes requiring small diameter rollers were deprived of the benefits of the new oscillating rollers. A roller having a ¼ inch helix pitch and a four inch diameter and a peripheral or lineal speed of 600 feet per minute will be rotating at 1,145 rpm. If the strikers in the helixes are located so that the roller shifts axially two inches and then returns to its original position, it will reverse 128 times per minute or over two times per second. A two inch diameter roller having a ¼ inch thread pitch and having a peripheral or lineal speed of 600 feet per minute would rotate at 4,584 rpm and would reverse 256 times per minute. Experience showed that large rollers, such as four inch diameter rollers, having ¼ inch thread pitch produced acceptable vibration when rotating at speeds up to 1,500 lineal feet per minute or about 1,435 rpm.

A two inch roller, having a peripheral speed of 1,500 feet per minute would be rotating at about 2,865 rpm and if the thread pitch were ¼ inch and the axial travel of the roller were two inches to the right and back two inches to the left there will be 358 reversals per minute. But the problem is that many of the latest printing press models, particularly web as opposed to sheet presses, run routinely at 2,000 feet per minute or more. Some presses that can run at 2,500 feet per minute are presently in use. Future presses are expected to run at as high as 3,000 feet per minute. An oscillating roller in a press that runs at only 2,000 feet per minute and an oscillating roller having a thread pitch of ¼ of an inch and an axial travel of two inches would reverse about 478 times per minute and such frequent reversals would tend to reduce the life of the oscillating roller.

Actually, every job run on a printing press entails different parameters. For some jobs, the amount of axial travel of the axial oscillating ink roller or rollers will be smaller or greater than for other jobs where the web feed rate is different. The amount of axial travel and the frequency of axial reversals differs between different jobs that are run on the same press. The use of different inks may dictate different axially oscillating rates or different web feed through rate. On some occasions, running the press at a very high speed results in production of heat which can thin the ink too much and produce an unsatisfactory printed product. In the patented oscillating rollers of the concealed oscillating mechanism type invented by applicant and in the prior art type that uses oscillating wobble or swash plates and gear trains to effectuate oscillation of one or more rollers when it was tolerable to speed up the web transport rate, the rate at which the rollers reciprocated axially increased proportionally and usually much more than was desirable in view of the particular printing format or artwork and the quality of the ink and other variables. In prior art presses, no means were provided for controlling the rotational rate of the axially oscillating ink roller nor the axial travel rate of the roller. The problems are becoming more aggravated as web speeds go higher and higher in every new printing press model that is manufactured.

SUMMARY OF THE INVENTION

An objective of the present invention is to provide an axially oscillating ink roller that can be used on presses and other coating machines that operate at the high speeds of the currently most advanced designs and in future presses and machines that operate at even higher maximum speeds.

Another important objective is to provide an oscillating roller which can be run equally well in either direction of rotation in the inker of a printing press or other coating machine.

A still further objective is to provide an axially oscillating roller drive mechanism in which all parts maintain their synchronism and cyclic periodicity under all operating circumstances.

Another objective of the invention is to provide for controlling the axial reciprocating speed of a roller independently of adjustments made in the rate at which the web is translated through the machine.

Yet another objective is to provide for adapting an oscillating roller so that it may be operated as a simple ordinary roller that does not oscillate at the option of the printing press operator.

Various embodiments of the new roller have some of the characteristics present in the axially reciprocating ink roller described in the aforementioned U.S. Pat. No. 4,509,426. As in the prior patent, the ink roller oscillates axially on a shaft that spans across the width of a printing press. The roller is in a sense, an idler roller which is rotated by being in tangential contact with a power driven roller in the inker. As in the cited patent, there are axially adjacent left and right hand twist helixes or threads inside of the roller and concentric to the shaft. The present invention, however, is an improvement over the prior design in that instead of having a rocking lever with a single prong at each end acting as a follower member alternately engaging and disengaging opposite helixes to cause the roller to move in one direction and then in the opposite direction an improved direction switching mechanism is used. In the improved axial oscillating mechanism, a single prong is replaced with a thread follower member on which there are a plurality of thread segments that engage the helixes so forces are distributed over a large area and unit stress is lower than where prongs are used. These follower members are like plungers that are each connected to one arm of a double armed lever, similar to bell cranks, which have their other arms interconnected and interlocked with an axially sliding rod rather than a rocking lever. When the roller turns on the thread segments of one follower member for being driven axially in one direction, a striker pin is ultimately contacted and it drives the one threaded follower member out of engagement with its mating helix and causes the other member to be driven into engagement with the internal thread or helix of opposite twist in the roller. The follower members are so designed and the timing of the mechanism is controlled in such a way that as a striker drives one follower member out of engagement a striker which is then in the proper angular relation to the threads on the other follower member captures the follower member so that there is no free play and the second member is engaged with its mating helix at the exact moment that the first follower member is disengaged.

A further improvement in the oscillating roller resides in making provision for varying the rate at which the roller oscillates axially independently of the rotational speed of the roller, that is, independently of the rate at which the web is feeding through the press. The change in axial rate can be made while the press is running at any speed. Varying the axial travel rate independently is accomplished by providing for driving the shaft on which the roller oscillates and rotates rotationally when a predetermined press speed is reached so that the relative speed between the roller and shaft will be altered in such manner that the axially oscillating rate which depends on the rotational rate of the rotor will change in correspondence with the rotational speed of the shaft. Generally, the controller for the press is programmed so that when the press is adjusted to run at a predetermined speed, the shaft rotation drive is cut in to reduce the speed at which the roller rotates relative to the shaft so the axial speed will be reduced correspondingly.

In another modification of the invention, the shaft on which the roller rotates and oscillates is mounted in bushings so that shaft can be caused to rotate. A coupling on the shaft serves as a brake drum. A brake band encircles the drum and is provided with means for drawing it tight so as to stop rotation of the shaft by frictional force. When the shaft is blocked against rotation, the roller rotates and oscillates in correspondence with the press speed as in the FIG. 2–8 embodiment. When the friction brake is released, the shaft can rotate freely and it will rotate under the influence of the driving force obtained from the axially oscillating roller itself. Collars are provided at opposite ends of the oscillating roller and these are clamped to the shaft so the roller can be blocked against oscillation. The clamping collars are used optionally for those printing jobs where the press speed and other variables are such that axial oscillating is not necessary. Thus, the friction brake and optional collar combination provides for using the roller as a conventional non-oscillating roller and by removal of the collars and clamping the roller shaft with the friction brake, the roller can be operated as an oscillating roller.

How the features just mentioned and other features of the invention are implemented will appear in the more detailed description of an illustrative embodiment of the invention which will now be described in reference to the drawings.

DESCRIPTION OF A PREFERRED EMBODIMENT

Figure 1:
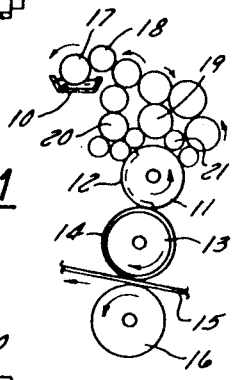
FIG. 1 is a schematic diagram of an abbreviated form of inker comprised of ink transfer rollers and the image plate supporting cylinder, blanket cylinder, and impression cylinder which comprise a typical offset printing press and in which inker one or more of the improved axially oscillating ink rollers may be used.

FIG. 1 is a diagram that is illustrative of the arrangement of rollers for transferring printers ink from a reservoir 10 to a printing plate cylinder 11 in one color stage of an offset printing press. A photolithographic plate that is mounted on cylinder 11 is depicted in dashed lines and marked 12. The objective of the invention is to assure that a thin uniform film of ink is applied to image plate 12. The blanket cylinder 13 is contiguous with the plate cylinder 11 and has its periphery encased in a rubber sleeve or mat 14 as typical of offset printing presses. As cylinders 11 and 13 rotate, image plate 12 periodically makes an impression on the outer surface of mat 14 and this impression is transferred to the top of paper web 15 which is passing through the press at high speed while the web is pressed against the blanket cylinder by an impression roller 16.

In FIG. 1, as is typical in offset printing presses, a plurality of rollers whose peripheries are in tangential contact with each other are used to transfer the viscous and greasy ink from reservoir 10 to the printing plate 12. Some of the rollers may have outer cylinders whose peripheries are metal and are highly polished and other rollers may have rubber-coated peripheries. The first roller in the series is the ink pick-up roller 17 which, as a result of rotating in the ink reservoir 10, becomes heavily coated with ink. Most of the ink is squeezed off by a swinging ductor roller 18 which is thereby coated with a film of ink. A thin coating of ink is, of course, deposited on the next roller 19 which brings about an exchange of ink with other rollers until the ink arrives at image plate cylinder 11.

Selected ones of the ink rollers are oscillated axially as they roll on the roller in which they are in contact. The new mechanism for axially oscillating the rollers may be incorporated in rollers 19 and 20, for example. The form roller 21, that is, a roller that transfers ink directly to image plate 12 may also be oscillating.

Figure 3:
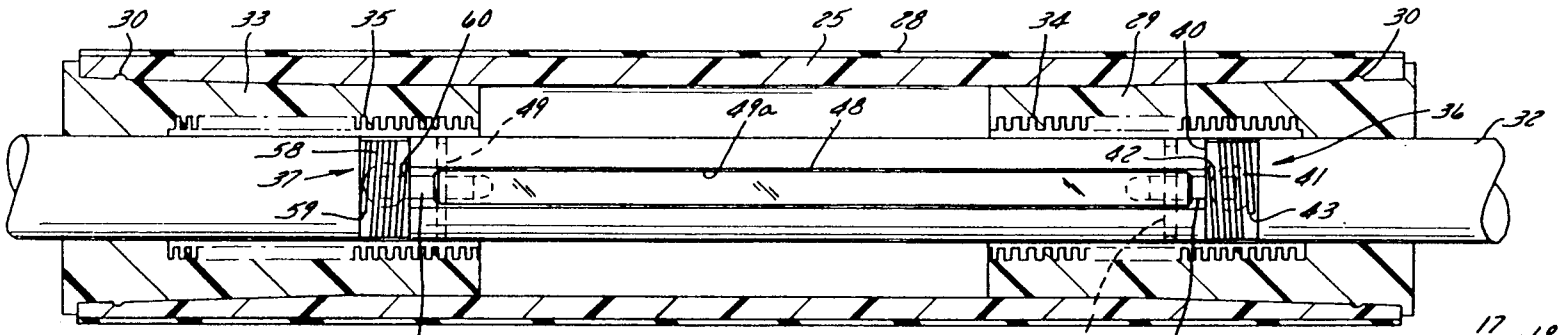
FIG. 3 is a transverse section taken on a line corresponding to 3—3 in FIG. 2.
Figure 2:
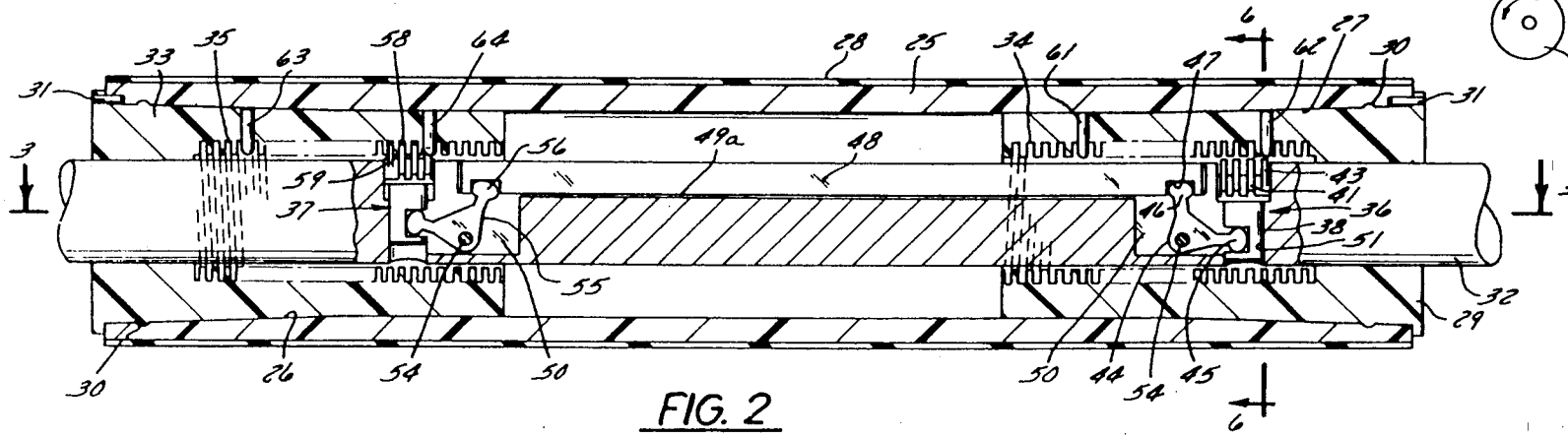
FIG. 2 is a vertical longitudinally extending section of the new axially oscillating ink roller and, as depicted, the roller has shifted to its leftmost position and the threaded follower member at the right has been disengaged from its cooperating right hand helix or thread and the threads on the follower member at the left are engaged with the left hand helix so that continued rotation of the roller in the clockwise direction looking at its right end will cause the roller to shift to the right.

Refer now to FIGS. 2 and 3. In this particular case, the roller is comprised of a plastic tube 25 that has internal tapers 26 and 27 extending inwardly from opposite ends. The roller tube has a rubber coating 28 in this case. In some rollers, the tube 25 is metal and has a highly polished periphery as is well known. There is a non-metallic sleeve 29 driven into the right end of the roller tube 25. The outside of sleeve 29 is tapered inwardly and the taper on the sleeve corresponds to the taper 27 inside of the roller tube so the sleeve wedges tightly inside of the tube. The sleeve has an external annular rib 30 which is substantially semi-circular in cross section and which registers in a corresponding annular groove inside of the tapered section 27 of roller tube 25. When the sleeve is driven inwardly of the roller tube, the rib 30 finally snaps into the annular groove and the sleeve is locked in so it cannot be withdrawn axially. An axially extending dowel pin 31 is driven into a preformed hole between roller sleeve 25 and the sleeve 29 to assure that there will not be relative rotation between the roller tube 25 and sleeve 29. In an alternative embodiment, not shown, the sleeve 29 has a male thread and the roller tube 25 has a female thread so these parts are screwed together.

The roller rotates and oscillates axially on a shaft 32 which is fixed at opposite ends to the press among the other rollers in the inker. The piece of the shaft 32 shown in all of the figures is drawn to the same length to make it easy for the reader to see how the parts of the roller oscillator mechanism move relative to each other. There is a tapered sleeve 33 at the left end of the roller comparable to sleeve 29 at the right end. Sleeves 29 and 33 also serve as bushings or bearings on which the roller rotates and oscillates axially. The sleeves are made of a hard, low friction plastic material such as nylon containing molybdenum sulphide which is commercially available. Very little total force is required to rotate the roller and actuate the mechanism for shifting the roller axially. This is one of the merits of the roller with a self-contained axial reciprocating mechanism as compared with prior art reciprocating rollers which are generally operated from their ends through gear trains, cams, swash plates and swinging levers which consume substantial amounts of power and increase axial travel speed proportionally regardless of how fast the press is run.

The right hand sleeve 29 in FIGS. 2 and 3 has an internal square thread or helix 34 extending over most of its length. Similarly, left sleeve 33 has an internal square thread or helix 35. The threads 34 in sleeve 29 and 35 in sleeve 33 have opposite twists. For the sake of example, assume in this case that the thread 34 in the right hand sleeve 29 is a right hand thread and the thread 35 in sleeve 33 is a left hand thread.

Figure 8:
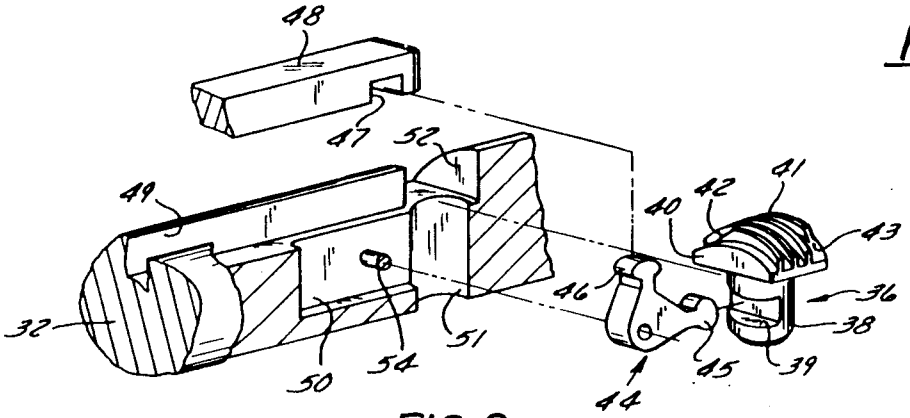
FIG. 8 is an exploded view of part of the stationary shaft, square connecting rod, double armed lever and threaded plunger which effectuates reversing the axial travel direction of the roller.

There is a unique thread follower member in the form of a plunger 36 mounted in the shaft 32 in the vicinity of right hand thread 34 in sleeve 29. There is a similar plunger 37 mounted in the shaft 32 for cooperating with the thread 35 in left sleeve 33. Elevation and plan views of the right hand plunger 36 are shown in FIGS. 2 and 3, respectively, and an isolated view is shown in FIG. 8. Referring to FIG. 8, plunger 36 comprises a stem 38 which has a slot 39 in its side. The stem resides in a hole 51 in shaft 32 and the head can retract in a chordal slot 52 in the shaft. A mushroom shaped head 40 is integral with stem 38. The head has thread segments 41 formed on it. These thread segments correspond in pitch and radius to the thread or helix 34 in sleeve 29, for example. The plural segments have substantial circumferential length so the forces developed between the thread segments and the internal sleeve threads are nicely distributed. Note in FIG. 8 and FIG. 6 that what might be called the leading thread segment starts with a ramp 42. The trailing thread segment terminates in a ramp 43. The stem 38 of plunger 36, for example, can reciprocate essentially diametrically of stationery shaft 32 and the plunger head can retract so as to be flush with the curved periphery of the shaft. In FIG. 2, the thread segments 41 are presently disengaged from the right hand helix or internal thread 34 so that if the roller were rotating, such rotation would be entirely free of the threaded plunger. The plunger 36, for example, is raised and lowered by means of a double armed lever 44 which has one end 45 substantially rounded and sized for fitting in slot 39 in plunger stem 38. The other end 46 of lever 44 is rounded and fits into a notch 47 in one end of a connecting link or rod 48. Link 48 resides in a longitudinally extending channel 49 like a keyway and the link is slidable axially in the channel. If link were shifted to the left as viewed in FIG. 2, right hand double armed lever 44 would rock counterclockwise on its pivot pin 54 and cause the thread segments 41 on plunger 36 to engage with internal thread 34 in sleeve 29. There is a slot 50 in shaft 32 in which double armed lever 44 rocks.

At the left end of FIG. 2, there is another double armed lever 55 whose one end 56 registers in a notch in connecting link 48. The other end of double armed lever 55 engages in a notch in the stem of plunger 37 similar to the way lever 44 cooperates with plunger 36 as was just explained. As can be seen particularly well in FIG. 3, the beginning of the thread 58 on plunger 37 is slanted as a ramp 59 and the other end of thread segments 58 ends in a ramp 60. The significance of these ramps on the thread will be elaborated later. It is important to note that the thread segments on both plungers 36 and 37 are capable of descending flush with the periphery of shaft 32. However, the pitch diameter of the thread segments on the plunger does not correspond to the diameter of the shaft 32 but to the pitch diameter of the internal thread or helix in the sleeves. Thus, the arcuate length of the thread segments on the plungers can be maximized.

Switching or changing the axial direction of movement of the reciprocating roller is achieved with four striker pins, two of which, 61 and 62, extend into the right hand thread 34 in right sleeve 29 and another two of which, 63 and 64, extend into internal left hand thread 35 in left sleeve 33. When the roller is rotating clockwise as viewed from its right end in FIG. 2, for example, right striker pin 62 and left striker pin 63 are active or used for causing reversal of the axial movement of the roller. When right striker pin 62 causes reversal or driving down of the thread bearing plunger, axially inward opposite left striker 64 serves to capture opposite plunger 37 by means of the striker being positioned at exactly the right time on the ramp that is formed at one end of the thread segments as previously mentioned. Assuming further that the roller is rotating clockwise as viewed from the right end in FIG. 2, when it is to shift in the opposite axial direction, axially outside striker pin 63 is used or is active to drive its plunger 37 out of mesh with internally threaded sleeve 33 and axially inside striker 61 performs the capture function. If the roller were in a press where it would be rotated counterclockwise as viewed from the right end in FIG. 2, axially inner right and left hand striker pins 61 and 64 are active to do the switching and axially outer strikers 62 and 63 perform the capture function. Because both ends of the roller and axially driving and reversing mechanism are symmetrical in every respect, this roller can be run at the full speed of the press in either direction of rotation. The angles at which the strikers are arranged about the axis of the roller will be discussed during the description of the operating mode of the roller which will now be undertaken.

Refer to FIG. 2 which shows the roller in one phase of operation. Assume that the roller is rotating clockwise about shaft 32 when viewed from the right end. The roller is presently driven axially to its leftmost limit. To be so driven, the thread segments 41 on the right hand plunger 36 were engaged with the internal right hand thread 34 in sleeve 29. Thus, with clockwise rotation the roller, in a sense, screws onto right hand thread segments 41 and advances to the left. A moment before the reciprocating mechanism reached the state in which it appears in FIG. 2, axially outermost right hand striker 62 rolled onto the ramp of the leading thread segment on which it is presently placed and caused the plunger 38 to be driven downwardly so as to unmesh the threads on the plunger with the threads 34 in the sleeve 29. Descent of the plunger 36 rocked lever 44 clockwise and caused link 48 to shift to the right. This resulted in clockwise rotation of the left double armed lever 55 and caused left plunger 37 to move upward so as to mesh the thread segments on plunger 37 with the internal left hand threads of the left sleeve 33. At the moment that the far right axially outermost striker 62 went onto the ramp or incline 43 of the thread segments 41, the striker pin 64 in the left hand thread 35 reached a corresponding position on the ramp on the first thread which is presently aligned with the left inner striker 64. Thus, striker 64 served to capture control over the left plunger 37 so that the segment threads 57 on the plunger enter their cooperating internal thread in the sleeve in exact angular relationship with the withdrawal of the right hand plunger thread segments 41 from the cooperating threads 34 in sleeve 29. The ramps on the leading or trailing threads of the opposite plungers each having ramps which are in contact with a striker pin during the momentary switching operation keeps the plungers under control at all times and prevents the unmeshed one from being driven up by an impulse when the double armed lever on the opposite end of the roller rocks abruptly.

Figure 6:
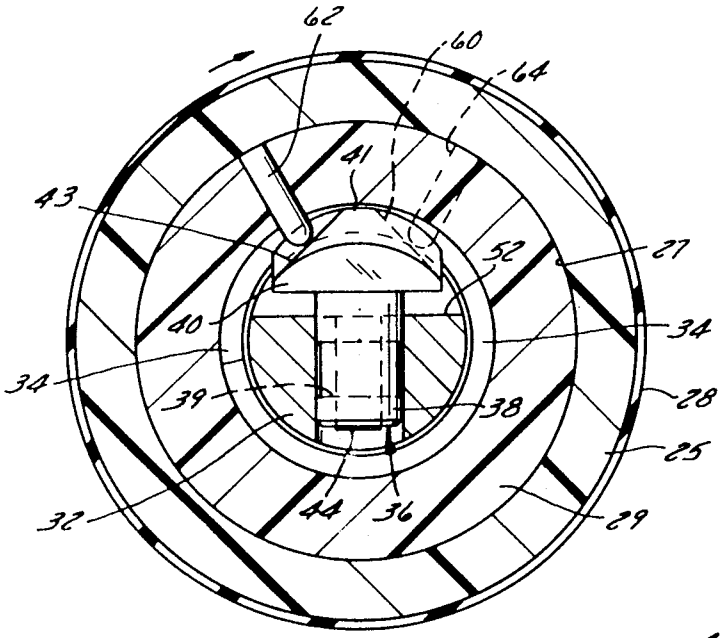
FIG. 6 is a section taken on a line corresponding to 6—6 in FIG. 2 and showing the parts at a rotational angle during the moment of switching when a striker pin in one of the helixes is driving its cooperating threaded plunger downwardly while another angularly displaced striker pin in the axially opposite helix is capturing or preventing uncontrolled movement of the threaded plunger in the axially opposite helix.

Attention is now invited to FIG. 6 which shows the two active pins, one acting as a striker and the other acting as the capturer, at the moment an axial reversal of the roller is about to begin. The roller is rotating clockwise as viewed in this figure and this is in correspondence with looking at the right end of the roller in FIG. 2. In FIG. 6, striker pin 62 is rotated to about 30° before top dead center and the tip of the right striker 62 is bearing on the ramp part 43 of thread segments 41 on the plunger 36 at the moment under consideration. Striker 62 is in the right hand internal thread 34 in sleeve 29. It is the axially outermost striker of the two strikers 62 and 61 which is in right hand thread 34. The striker 64 shown in dotted line in FIG. 6 is the axially innermost striker in the left hand thread 35. Note that segment threads 41 on plunger head 40 at the right end of the roller are engaged and the plunger 36 is in its uppermost position in FIG. 6. In FIG. 2, the right hand follower is unmeshed already but the picture in FIG. 2 was taken a moment before unmeshing occurred. Now, the striker pin 62 which is rotating clockwise runs up on the ramp 43 and begins to push the plunger 36 down to disengage plunger thread segments 41 from the right hand helical threads 34. At this time, left striker pin 64 is also on the ramp 60 of the left thread segment 58. As mentioned earlier, the purpose of having striker 64 capture its associated threads 58 on left plunger 37 is to assure that the timing relationship between the parts is maintained since there will be no free impulse travel and no free projection of the plunger.

Figure 7:
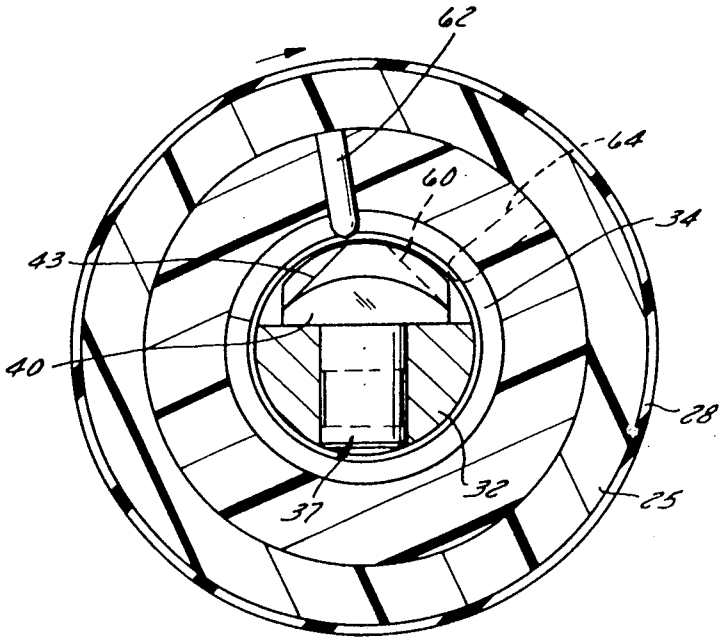
FIG. 7 is similar to FIG. 6 except that it shows the mechanism at a slightly more advanced angle of rotation.

Referring to FIG. 7, as clockwise rotation of the roller continues, it will be evident that right hand plunger 36 as in FIG. 2 will be driven down under the influence of striker pin 62 and left striker pin 64 will run off of the ramp and will be clear because as soon as the plunger 37 in FIG. 7 was engaged with its cooperating left hand helix 35, the roller begins to move axially and thread 35 clears striker pin 64.

In FIG. 2, the thread segments on the left hand plunger 37 are engaged with the left hand thread in the sleeve 33 and rotation of the roller is clockwise from the right end so the roller begins to shift axially to the right on the left hand thread.

Figure 4:
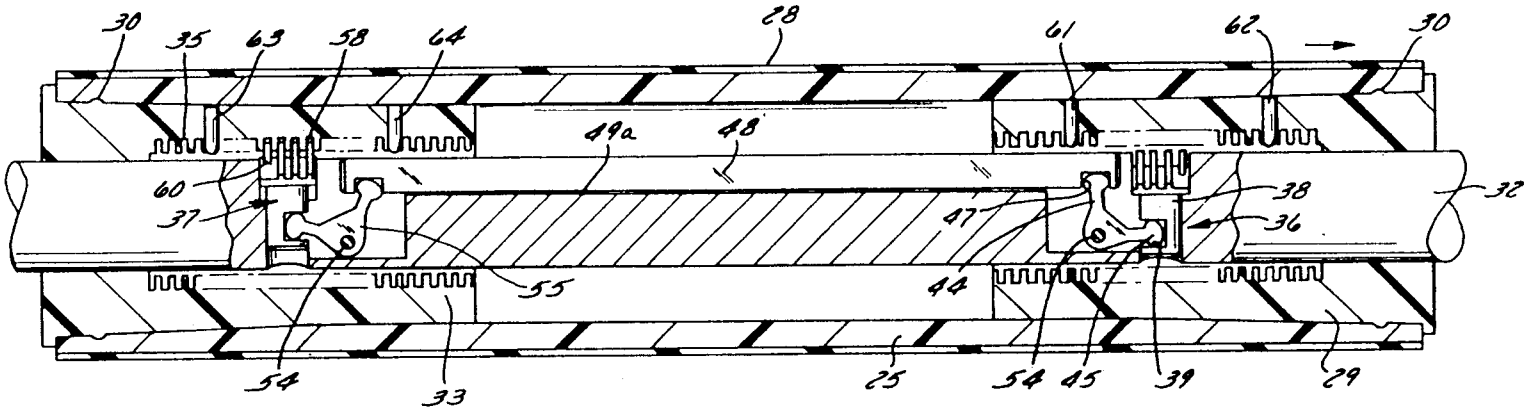
FIG. 4 shows the roller at an intermediate stage wherein it is shifting to the right and is presently about halfway to its rightmost limit.

FIG. 4 shows right axial movement of the roller in progress. The engaged thread segments 58 on the left plunger are between striker pin 63 and 64 so there is no diametrical force acting on left plunger 37. Because the roller is being forced to the right as it rotates clockwise on a left hand thread, there is an axially directed force on the threads of the plunger but this force just tends to hold the thread segments into engagement with the threads in the sleeves. This is a time to take note again of the great advantage of using the multiple thread segment type of plunger as opposed to using a single prong plunger engaging a single thread in the sleeve at all times. By using the multiple thread segments, the axial stress due to shifting of the roller in one direction or another is distributed over the relatively large area that occurs between the interfaces of the male threads on the plungers and the internal female threads in the sleeves. This, of course, reduces wear on the threads. Moreover, and most importantly, the pitch between the helical grooves or threads in the sleeves can be made much smaller, that is, the sleeve threads can be made much finer because the axial forces are distributed over a greater number of the sleeve threads when a plurality of follower threads are engaged with them. This is advantageous in that the finer pitch means that the roller can make more revolutions within a fixed axial distance which is desirable since any point on the roller will make a closer pitched spiral on the adjacent driving roller in which case better distribution of the ink will result.

Figure 5:
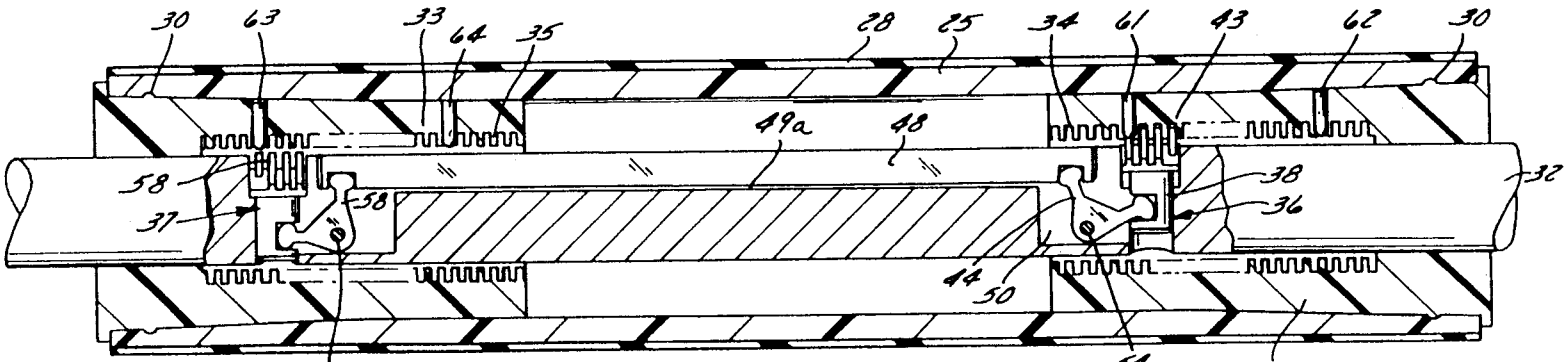
FIG. 5 shows the roller at its rightmost limit.

In FIG. 5, the roller has turned on its left hand thread 35 and this screwing action during clockwise rotation from the right end of the roller has caused the left striker pin 63 to strike the leading thread with the ramp on it in the group of thread segments 58. Plunger 37 has been driven downwardly by the action of striker 63 and the threads have been disengaged from the helical grooves 35 in the left sleeve 33. Descent of plunger 37 has caused double armed lever 55 to rock counterclockwise, thereby shifting connecting link 48 to the left. Link 48, thus, transmits a force to the right double armed lever 44 which rocks it counterclockwise, thereby driving plunger 38 upwardly to effect meshing between the multiple threads 43 in plunger 38 and the threads 34 in the right sleeve 29. When the roller is just about at its right axial limit as it is in FIG. 5, left outside striker pin 63 is active to drive plunger 37 downwardly and right inner striker pin 61 does the capturing as previously explained in connection with having the roller reach its left limit.

As mentioned, since the oscillating mechanism for the roller is completely symmetrical, the roller can be rotated in either direction at full press speed. If the roller is rotated counterclockwise as when looking at the right end of the roller in the drawings, the left and right axially inside striker pins 64 and 61, respectively, switch the plungers to do the axial direction changing and the axially outward left and right striker pins 63 and 62 do the capturing at each end of an oscillation cycle.

The FIGS. 2–8 embodiment of the axially reciprocating ink roller thus far described is basic and suitable for general use. One of its characteristics is that as the speed of the press is increased there is a proportional increase in the speed of the axial oscillations. Up to a certain speed, this is acceptable but usually at higher speeds it would be desirable to slow down the axial oscillations.

Figure 9:
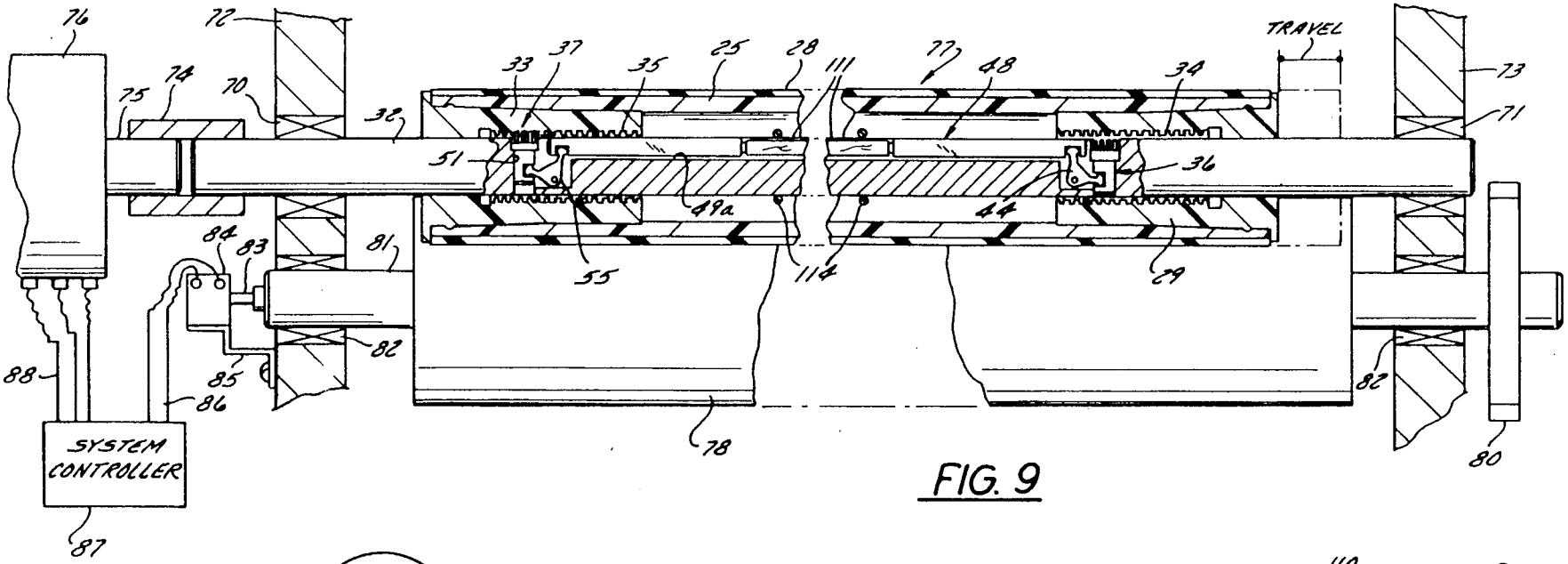
FIG. 9 shows an embodiment of the new axially oscillating ink roller wherein the shaft on which the roller rotates and oscillates is adapted for being driven rotationally by electric motor for the purpose of controlling the rate of axial travel of the roller.
Figure 10:
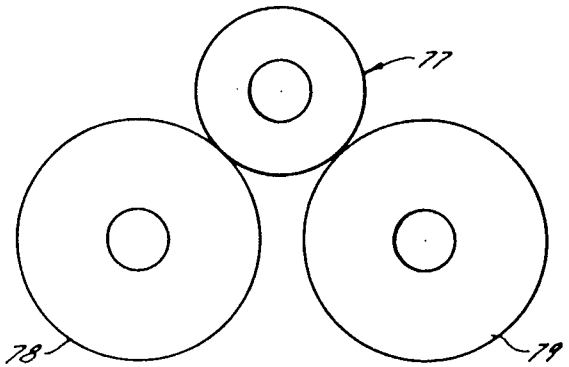
FIG. 10 is a diagram of the oscillating roller on top in contact with two roller ordinary ink rollers.

One reason is that at high rotational speeds, the rollers in the inker generate substantial heat by themselves due to the friction between rollers that are simply rotating in tangential contact with each other and more heat is generated by the axially oscillating rollers. Furthermore, better distribution of ink may result if the axial travel rate of the roller is held lower than proportional to rotational speed. Another reason is that wear of the roller oscillating mechanism would be accelerated by running the roller at a higher than required axial travel rate. The FIG. 9 embodiment of the axially oscillating roller provides for controlling the axial travel rate independently of the rotational rate of the roller. In FIG. 9, the roller supporting shaft 32 is given the same reference numeral as in the preceding figures since the shaft is essentially the same. As opposed to the previously discussed embodiment, in FIG. 9 shaft 32 is not clamped to the press frame but is journalled for rotation in bushings 70 and 71 in press frame members 72 and 73. Main shaft 32 is coupled by means of coupling 74 to the shaft 75 of a variable speed electric motor 76. The oscillating ink roller is designated generally by the numeral 77 in FIG. 9 and in FIG. 10, too. Roller 77 is in contact with two other non-oscillating ink rollers 78 and 79, for example. For illustrative purposes in FIG. 9, one of the regular ink rollers 78 is driven rotationally by the output gear 80 of a gear train which is not shown. In any event, by driving regular roller 78 rotationally, axially reciprocating roller 77 which is in frictional contact with roller 78 is compelled to rotate and thereby obtain the energy for reciprocating axially. The roller will reciprocate axially at a rate proportional to its rotational speed if the shaft is prevented from rotating. The shaft 81 of roller 78, for example, is journalled for rotation in bushings such as the one marked 82 in press frame member 72.

In FIG. 9 means are provided for sensing the rotational speed of the inker rollers and for causing the motor 76 to drive the shaft 32 rotationally in correspondence with the roller rotational speed. Driving shaft 32 rotationally when the roller 77 is being driven rotationally changes the speed of roller cylinder 78 relative to shaft 32. Likewise, there is a change in the rotational speed of the internal threads 34 and 35 in sleeves 29 and 33 relative to their cooperating threaded plunger members 36 and 37. It will be evident that if the shaft 32 is rotated at the same speed as the roller is being driven by an adjacent contacting roller, the right and left internal threads 34 and 35 in the roller sleeves would not be moving relative to their thread segments on follower members or plungers 36 and 37, respectively, in which case axial travel of the roller would be reduced to zero. Varying the motor speed varies the shaft speed so that axial speeds ranging from zero to a speed directly proportional to rotational speed can be obtained. The shaft can be locked against rotation with a brake or by locking the motor rotor electrically.

There are many ways in which to sense press speed and program a controller to vary the speed at which the roller shaft is rotated to thereby control axial travel rate of the roller. By way of example, in FIG. 9, the shaft 83 of a tachometer 84 is coupled to the shaft 81 of roller 78 which drives the oscillating roller 77 and whose rotational speed is proportional to that of roller 77. Tachometer 84 can be supported on the press frame with a bracket 85. The tachometer produces an electric signal which is proportional to roller speed and which is transmitted by way of conductors 86 to a system controller represented by the block 87. The system controller varies the electric supply delivered to motor 76 by way of lines 88 to thereby control motor speed. Many modern presses are controlled with microprocessor based controllers, not shown. Such controller can be programmed to develop any relationship between the speed of motor 76 or, shaft 32, in relation to the rotational speed of driving roller 78. The axial travel rate can be allowed to increase linearly or in proportion to roller rotational rate until a certain axial speed is reached at which time shaft rotation can be started and continually increased to maintain axial rate at some permissible upper limit. By driving the system conversely, that is, by causing motor 76 to operate in reverse, the axial oscillation rate of the roller can be made to increase with increasing rotational rate of the inker rollers.

Figure 12:
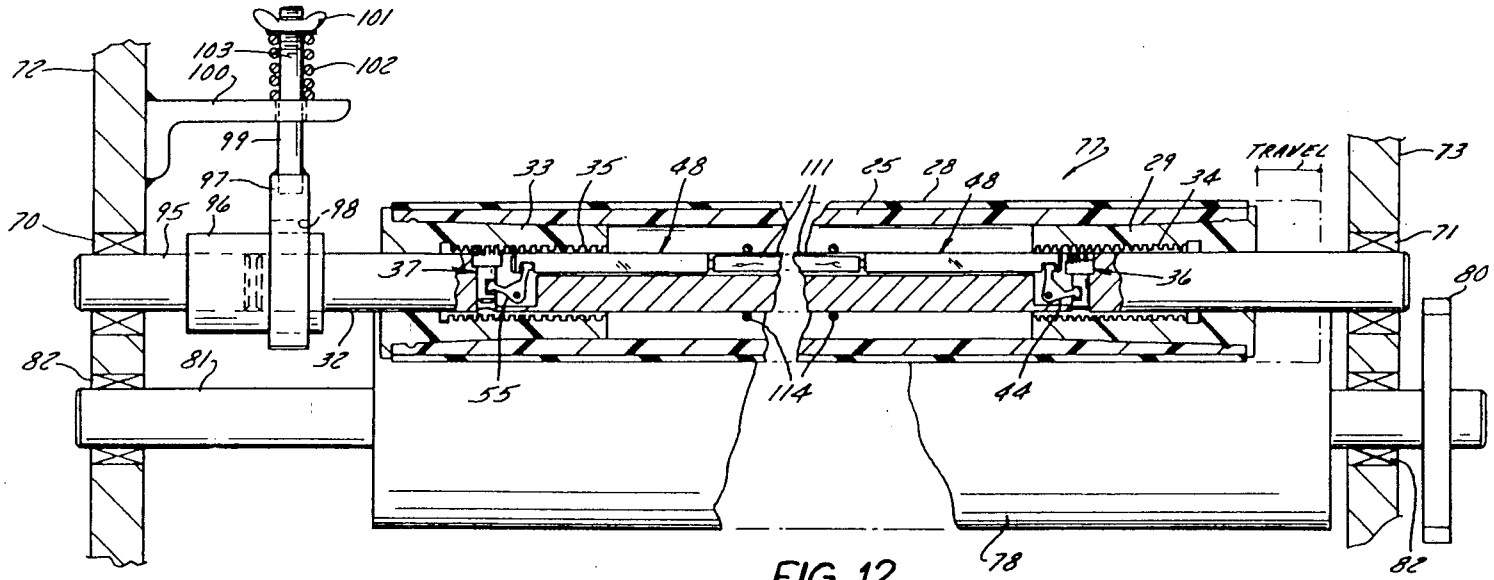
FIG. 12 depicts the axially oscillating roller on a shaft that is mounted in bearings in the frames of the press and wherein the shaft can be clamped against rotation by means of a brake to permit axial oscillation of the roller or the brake can be released to permit the shaft to rotate so as to remove the driving force for moving the roller axially.

FIG. 12 shows an alternative scheme for varying the oscillation rate of the roller through the range of zero oscillation rate to a rate proportional to roller rotational speed. In this figure, the oscillating roller 77 and the roller 78 by which the oscillating roller is driven are the same as in FIGURE 9 which was just discussed. FIG. 12 is illustrative of controlling the rotational speed of shaft 32 with a friction brake. Thus, shaft 32 is coupled to a stub shaft 95 by means of a smooth cylindrical coupling 96 which serves as a brake drum. The shaft is journalled for rotation in bushings 70 and 71 which are fixed in press frame members 72 and 73. A metal brake band 97 is circular in cross-section and is lined on its inside with brake lining 98 which may be a conventional brake lining material. A threaded stud 99 is fastened to opposite ends of brake band 97. Threaded stud 99 passes with clearance through a bracket 100. There is a wing nut 101 on stud 99 and a spring 102 interposed between the nut and the top surface of bracket 100. When wing nut 101 is turned down the thread 103 on the stud, the spring 102 is loaded and it pulls the brake lining against drum 96 so as to retard rotation of shaft 32. When the brake is tightened sufficiently for the shaft to be non-rotating, the axial oscillation rate of the roller will be maximum or directly proportional to the roller rotational speed. If the wing nut 101 is turned off sufficiently to apply no compressive force to spring 102, the friction brake will be fully released in which case shaft 32 can turn freely such that there will be no axial oscillation of the roller.

Figure 13:
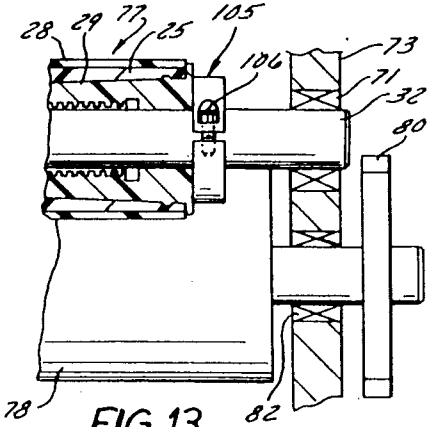
FIG. 13 is a fragmentary view of the oscillating roller wherein collars are mounted on the shaft for blocking the roller against any axial movement and allowing it to function as an ordinary ink roller as is desirable in some web printing jobs.

FIG. 13 shows a fragment of the end of the roller 77 and of the shaft 32 on which a collar 105 is fixed adjacent the end of the roller. The collar is made in two semi-circular parts which allow it to be split and placed on the shaft 32 and clamped to the shaft by tightening screws 106. These collars are intended to be applied or removed at the option of the press operator who will have the collars applied in accordance with whether or not the oscillating feature of the roller is wanted for a particular press run. Thus, in the FIG. 12 embodiment, for example, the collars 105 can be clamped to the shaft 32 at both ends of the roller to prohibit any axial travel of the roller. The brake would always be released if the collars are applied since the shaft 32 must rotate freely under such circumstances. The FIG. 12 and 13 scheme is demonstrative of providing the roller with the capability of being used as an ordinary non-oscillating roller for press runs where oscillation is not needed.

Figure 11:
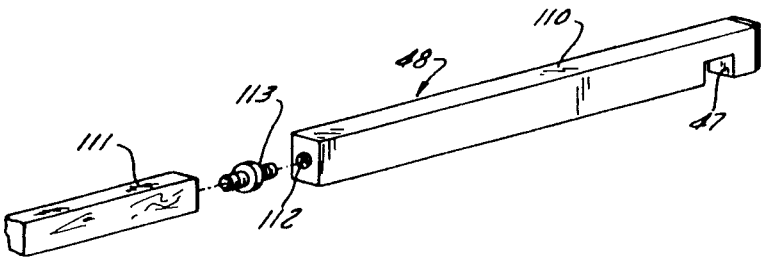
FIG. 11 is a perspective view of a modified form of axial direction reversing link used in the axially oscillating roller.

In the FIGS. 2–9 embodiment, the link 48 which connects between the rocking double-armed levers 44 and 45 is shown as a solid square rod which is made of metal and has substantial mass. This link is almost the length of the oscillating roller which spans across the width of a press which may be four or more feet. To reduce the mass, the link 48 depicted in FIG. 11 is preferred. This link is also used in the FIG. 9 and 12 embodiments. In FIG. 11, the end portion 110 of link 48 is a square metal rod. The long intermediate part 111 of the link which joins the end portions 110 is preferably comprised of a lightweight material such as wood or plastic. Parts 111 and 110 have a threaded hole such as the one marked 112 in their ends to facilitate joining parts 110 and 111 by means of a shouldered threaded stud 113. It may also be added that in the embodiments wherein the shaft 32 is rotated to slow down axial movement of the roller, means are provided to assure that the centrifugal force generated by connecting link 48 will have no tendency to rock the double-armed levers. The means, as demonstrated in FIG. 9, are one or more rubber O-rings such as the one marked 114 in FIGS. 9 and 12.

I claim:

1. A roller for use in a printing or coating machine, comprising:

a shaft for being mounted to said machine, a cylindrical roller mounted for rotating on said shaft in response to being driven rotationally and for oscillating axially on said shaft, generally cylindrical means fixed in said roller for rotating with the roller, said means containing internal left and right hand threads arranged coaxially with each other and encircling said shaft, first and second axially spaced apart follower members mounted in said shaft for moving radially between extended and retracted positions, said first follower member arranged for engaging and disengaging said right hand internal thread and said second follower member arranged for engaging and disengaging said left hand internal thread when said follower members are alternately contracted and extended, so as to cause said roller to oscillate axially on said shaft, a first striker element fixed in said right hand thread and a second striker element fixed in said left hand thread for respectively determining the limits of axial travel of said roller in opposite directions on said shaft when said roller is rotating in one direction and for causing axial reversal of said roller, link means disposed for shifting in an axially extending slot in said shaft, one lever means pivotal on said shaft and operatively connected to said first follower member and one end of said link means and another lever means pivotal on said shaft and operatively connected to said second follower member and the other end of said link means, the force of one striker element striking one follower member disengaging said follower member from an internal thread and actuating one lever connected to said member and link to transmit said force lengthwise of said link for actuating the other lever to force the other follower into engagement with the other internal thread for reversing the axial travel direction of said roller.

2. The roller according to claim 1 wherein said link means has opposite end portions composed of metal and a portion intermediate of said end portions having opposite ends connected to opposite metal end portions, said portion intermediate being composed of a rigid material having lighter weight than said end portions.

3. The roller according to claim 2 wherein said material intermediate the ends of said link is wood.

4. The roller according to claim 1 including:

means supporting said shaft for rotation, motor means and means operatively coupling said motor means to said shaft for optionally driving said shaft rotationally, means for adjusting the speed of said motor means so as to change the speed of said shaft relative to the rotational speed of said roller and to said internal left and right hand threads so that said roller can be controlled to oscillate in opposite axial directions at speeds other than a speed that is directly proportional to the rotational speed of said roller.

5. The roller according to claim 4 including means for sensing the rotational speed at which said roller is being driven, and said motor means speed adjusting means responding to the sensed roller rotational speed by starting or adjusting the speed of said motor means accordingly.

6. The roller according to claim 1 including;

means supporting said shaft for rotation, means operative to selectively apply and release braking force on said shaft to stop or permit rotation of said shaft.

7. The invention according to any one of claims 1, 2, 3, 4, 5 or 6 wherein said machine is a printing press.

8. A roller for use in a printing or coating machine, comprising:

a shaft for being mounted to said machine, said roller being mounted for rotating on said follower members are caused to engage with the other internal thread so as to cause said roller to move oppositely of said one axial direction. shaft in response to being driven rotationally and for oscillating axially on said shaft, generally cylindrical means fixed in said roller for rotating with the roller, said cylindrical means containing internal left and right hand threads arranged coaxially with each other and encircling said shaft, first and second axially spaced apart follower members mounted in said shaft for moving radially between extended and retracted positions, said first follower member having a plurality of right hand thread segments arranged for engaging and disengaging said right hand internal thread and said second follower member having a plurality of left hand thread segments arranged for engaging and disengaging said left hand internal thread when said follower members are alternately extended and contracted, respectively, so as to cause said roller to oscillate axially on said shaft, a first striker element fixed in said right hand thread and a second striker element fixed in said left hand thread for determining the limits of axial travel of said roller to the left and to the right on said shaft when said roller is rotating in one direction and for causing axial reversal of said roller, means for interconnecting said follower members such that when said roller is driven rotationally in one direction and moves axially in one direction the striker element in one of said internal threads strikes the thread segments on the follower member engaged with said one thread and said thread segments on said one follower member become disengaged while the thread segments on the other of the follower members are caused to engage with the other internal thread so as to cause said roller to move oppositely of said one axial direction, said means for interconnecting said follower members comprises first and second levers mounted to said shaft for pivoting about axes transverse to the axis of said shaft, said first lever being operatively connected to said first follower member and said second lever being operatively connected to said second follower member, and link means extending along said shaft and having opposite ends operatively connected to said first and second levers, respectively, such that when a striker element forces the thread segments of one of said follower members to unmesh from its cooperating internal thread said link means is shifted axially by the lever connected to said one follower member and said link means causes the other lever to pivot and force the thread segments on the other of said follower members to mesh with the other internal thread.

9. The roller according to claim 8 wherein said link means has opposite end portions composed of metal and there is a segment of said link means composed of anonmetallic substance interposed between and connected to said end portions.

10. The roller according to claim 9 wherein said segment intermediate said end portions of the link is composed of wood.

11. The roller according to claim 8 wherein:

said follower members are comprised of heads on one of which said left hand thread segments are formed and on the other of which said right hand thread segments are formed, said shaft having recesses for guiding said follower members to move radially alternately under the influence of said means for interconnecting said follower members.

12. The roller according to claim 8 wherein said shaft has slots in which said follower members move radially and the radius of curvature of said thread segments on said follower members is substantially equal to the radius of said shaft and said follower members are retractable sufficiently for said thread segments to be substantially flush with the periphery of said shaft.

13. The roller according to claim 8 including:

means supporting said shaft for rotation, motor means and means operatively coupling said motor means to said shaft for optionally driving said shaft rotationally, means for adjusting the speed of said motor means to change the speed of said shaft relative to the rotational speed of said roller and to said internal left and right hand threads so that said roller can be controlled to oscillate in opposite axial directions at speeds other than a speed that is directly proportional to the rotational speed of said roller.

14. The roller according to claim 13 including means for sensing the rotational speed at which said roller is being driven, and said motor means speed adjusting means responding to the sensed roller rotational speed by starting or adjusting the speed of said motor means accordingly.

15. The roller according to claim 8 including:

means supporting said shaft for rotation, means operative to selectively apply and release braking force on said shaft to stop or permit rotation of said shaft.

16. The invention according to any one of claims 8, 10, 11, 12, 13, 14 or 15 wherein said machine is a printing press and said coating material is ink.

17. A roller for use in a machine for applying a coating material to sheet material comprising:

a shaft for being mounted to said machine, said roller being mounted for rotating and oscillating axially on said shaft, generally cylindrical means fixed in said roller for rotating with the roller, said cylindrical means containing internal left and right hand threads arranged coaxially with each other and encircling said shaft, first and second axially spaced apart follower members mounted in said shaft for moving radially between extended and retracted positions, said first follower member having a plurality of right hand thread segments arranged for engaging and disengaging said right hand internal thread and said second follower member having a plurality of left hand thread segments arranged for engaging and disengaging said left hand internal thread when said follower members are alternately extended and contracted, respectively, so as to cause said roller to oscillate axially on said shaft, a first striker element fixed in said right hand thread and a second striker element fixed in said left hand thread for determining the limits of axial travel of said roller to the left and to the right on said shaft when said roller is rotating in one direction and for causing axial reversal of said roller, means for interconnecting said follower members such that when said roller is driven rotationally in one direction and moves axially in one direction the striker element in one of said internal threads strikes the thread segments on the follower member engaged with said one thread and said thread segments on said one follower member become disengaged while the thread segments on the other of the follower members are caused to engage with the other internal thread so as to cause said roller to move oppositely of said one axial direction, a third striker element in said right hand internal thread and a fourth striker element in said left hand internal thread, said first and second striker elements being the axially outermost striker elements and said third striker element being axially inward from said first element in said right hand internal thread and said fourth striker element being axially inward from said second element in said left hand internal thread, said third and fourth striker elements determining the limits of axial travel of said roller when said roller is rotating in a direction opposite of said one direction and said third and fourth striker elements causing axial reversal of said roller, the ends of the first and the last thread segments among said plurality of thread segments on each follower member being beveled, said first striker element in said right hand internal thread and said third striker element in said left hand internal thread being separated by such angle about the axis of rotation of said internal threads that when said first striker element starts rotating onto said beveled portion of the thread segment on the follower member with the right hand thread segments to unmesh said follower member, said third striker element is aligned with said beveled portion of the thread segment on the follower member having the left hand thread segments so said third striker element captures said left hand threaded follower and turns away to permit said left hand threaded follower to mesh with said left hand internal thread and drive said follower in one axial direction, said second striker element in said left hand internal thread and said fourth striker element in said right hand internal thread being separated by such angle about the axis f rotation of said internal thread that when said second striker elements starts moving onto said beveled portion of the follower member having the left hand thread segments to unmesh said follower member said fourth striker element is aligned with said beveled portion of the thread segment on the follower member having the right hand thread segments so said fourth striker element captures said right hand threaded follower and turns away to permit said follower having the right hand thread segments to mesh with said right hand internal thread and drive said roller in an axial direction opposite of said one direction.

18. A roller adapted for oscillating in opposite axial directions in a printing or coating machine, comprising:

a shaft for being mounted to said machine for rotating, a cylindrical roller mounted for being driven rotationally on said shaft and for oscillating axially on said shaft, generally cylindrical means fixed in said roller, said means containing internal left and right hand threads arranged coaxially and encircling said shaft, first and second follower members arranged in axially spaced apart relationship along said shaft inside of said internal threads, respectively, means for interconnecting said follower members such that when one follower member is engaged with one of the threads to drive said roller in one axial direction the other follower member is disengaged in readiness for engaging the other thread to drive said roller in a direction opposite of said one direction, means operative when said roller is driven to a predetermined limit in each axial direction to disengage the follower member from the thread that is causing said roller to be driven in one axial direction for said means for interconnecting to cause engagement of the other follower member with the other thread to cause said roller to be driven axially opposite of said one direction, motor means and means operatively coupling said motor means to said shaft for optionally driving said shaft rotationally, means for adjusting the speed of said motor means to change the speed of said shaft relative to the rotational speed of said right and left hand internal threads so said roller is controllable to oscillate in opposite axial directions at speeds proportional to the rotational speeds of said roller and said shaft.

19. The roller according to claim 18 including means for sensing the rotational speed at which said roller is being driven, said means for adjusting said motor means speed responding to the sensed roller rotational speed by starting or adjusting the speed of said motor means to maintain a selected oscillation speed.

* * * * *

UNITED STATES PATENT AND TRADEMARK OFFICE

CERTIFICATE OF CORRECTION

PATENT NO. : 5,065,676

DATED : November 19, 1991

INVENTOR(S) : Philip J. Hardin

It is certified that error appears in the above—identified patent and that said Letters Patent is hereby corrected as shown below:

Column 14, lines 34-37:

After "on said" delete "follower members are caused to engage with the other internal thread so as to cause said roller to move oppositely of said one axial direction."

Column 17, line 14:

After "axis" delete "f" and substitute --- of ---.

Signed and Sealed this

Sixth Day of April, 1993

*Attest:*

STEPHEN G. KUNIN

*Attesting Officer*

*Acting Commissioner of Patents and Trademarks*